US011415397B2

(12) United States Patent
Metzger et al.

(10) Patent No.: US 11,415,397 B2
(45) Date of Patent: Aug. 16, 2022

(54) ADDITIVE MANUFACTURING OF ENERGETIC MATERIALS IN OIL WELL SHAPED CHARGES

(71) Applicant: HALLIBURTON ENERGY SERVICES, INC., Houston, TX (US)

(72) Inventors: Jason P. Metzger, Joshua, TX (US); Gerald G. Craddock, Jr., Mansfield, TX (US); Nicholas G. Harrington, Midlothian, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 835 days.

(21) Appl. No.: 16/314,367

(22) PCT Filed: Jan. 5, 2018

(86) PCT No.: PCT/US2018/012679
§ 371 (c)(1),
(2) Date: Dec. 28, 2018

(87) PCT Pub. No.: WO2019/135762
PCT Pub. Date: Jul. 11, 2019

(65) Prior Publication Data
US 2021/0223006 A1 Jul. 22, 2021

(51) Int. Cl.
*F42B 1/036* (2006.01)
*E21B 43/117* (2006.01)

(52) U.S. Cl.
CPC ..... *F42B 1/036* (2013.01); *E21B 43/117* (2013.01)

(58) Field of Classification Search
CPC ..... F42B 1/036; E21B 43/117
USPC ..... 89/1.15, 1.151; 102/306–310, 476
See application file for complete search history.

(56) References Cited

U.S. PATENT DOCUMENTS 2,628,559 A * 2/1953 Jasse ..... F42B 3/08 102/306
3,100,445 A * 8/1963 Poulter ..... F42B 1/024 102/309
3,136,249 A * 6/1964 Poulter ..... F42B 1/032 102/309

(Continued)

FOREIGN PATENT DOCUMENTS

CN 104989552 B 1/2017
WO WO-216161376 A1 10/2016

OTHER PUBLICATIONS

Koreoan Intellectual Property Office, International Search Report and Written Opinion, PCT/US2018/012679, dated Sep. 14, 2018, 14 pages, Korea.

*Primary Examiner* — Bret Hayes
(74) *Attorney, Agent, or Firm* — Haynes and Boone, LLP

(57) ABSTRACT

A shaped charge for use in a well perforating tool includes at least one explosive component fabricated by an additive manufacturing process such as three-dimensional printing. The additive manufacturing process may facilitate the production of complex geometries including voids and/or density gradients in the explosive materials that, when detonated, produce a specific penetration effect in a wellbore. The explosive materials may be deposited individually as a pellet, or may be deposited on one or both of a case and a liner acting as a scaffold during the additive manufacturing process.

20 Claims, 6 Drawing Sheets

(56) References Cited

U.S. PATENT DOCUMENTS

| | | | | | |
|---|---|---|---|---|---|
| 4,004,518 | A * | 1/1977 | Potteiger | F42B 12/22 | 102/495 |
| 4,291,624 | A * | 9/1981 | Sabranski | F42B 1/024 | 102/306 |
| 4,716,833 | A * | 1/1988 | Regalbuto | E21B 43/117 | 102/307 |
| 4,901,619 | A | 2/1990 | Sassmannshausen | | |
| 5,194,690 | A * | 3/1993 | Guthrie | F41A 1/00 | 102/307 |
| 5,271,332 | A * | 12/1993 | Guirguis | F42B 1/02 | 102/283 |
| 5,322,020 | A * | 6/1994 | Bernard | F42B 1/024 | 102/306 |
| 5,479,860 | A | 1/1996 | Ellis | | |
| 5,565,644 | A | 10/1996 | Chawla | | |
| 6,983,698 | B1 * | 1/2006 | Walters | F42B 1/02 | 102/305 |
| 8,813,651 | B1 | 8/2014 | Hooke | | |
| 2003/0056982 | A1 | 3/2003 | Fayard | | |
| 2003/0177933 | A1 * | 9/2003 | Fortner | F42B 12/16 | 102/476 |
| 2010/0043661 | A1 * | 2/2010 | Graham | F42B 1/02 | 102/307 |
| 2013/0061771 | A1 | 3/2013 | Betancourt | | |
| 2013/0320598 | A1 | 12/2013 | Atkins | | |
| 2014/0291022 | A1 | 10/2014 | Yang | | |
| 2016/0169639 | A1 | 6/2016 | Smart | | |
| 2017/0241754 | A1 * | 8/2017 | Gash | F42B 1/036 | |

* cited by examiner

ADDITIVE MANUFACTURING OF ENERGETIC MATERIALS IN OIL WELL SHAPED CHARGES

CROSS-REFERENCE TO RELATED APPLICATIONS

This application is a U.S. national state patent application of International Patent Application No. PCT/US2018/012679, filed on Jan. 5, 2018, the benefit of which is claimed and the disclosure of which is incorporated herein by reference in its entirety.

BACKGROUND

The present disclosure relates generally to wellbore completions, e.g., for wellbores employed in oil and gas exploration and production. More particularly, embodiments of the disclosure relate to energetic devices such as explosives, propellants, pyrotechnics and shaped charges that may be detonated in a wellbore, e.g., to provide penetration into a geologic formation surrounding the wellbore. The energetic devices may include components fabricated using an additive manufacturing process.

Hydrocarbons may generally be produced through wellbores drilled from a surface location through a variety of producing and non-producing geologic formations. A wellbore may be substantially vertical, or may include horizontal and other deviated portions. A variety of servicing operations may be performed in a wellbore once drilling has been completed. For example, one or more casing strings can be set and cemented in the wellbore, e.g., to stabilize the geologic formation surrounding the wellbore. The casing strings, cement and/or geologic formation may be penetrated by firing a perforation gun or perforation tool at an appropriate depth in the wellbore. Creating a large perforation in the casing or geologic formation is often desirable to increase the permeability of hydrocarbons into the wellbore. In some instances, a limited or controlled explosive charge may be desirable to generate a specific penetration effect.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes energetic components constructed by additive manufacturing processes such as three-dimensional printing. The energetic components may include propellants, pyrotechnics and explosive materials used in wellbore perforating tools. For example, the explosive materials in a shaped charge may be constructed with complex geometries such as voids or cavities (either fully enclosed within the explosive or extending to an outer surface of the explosive), or layers of specific materials, densities or concentrations of explosive material to produce a specific penetration effect when the shaped charge is detonated.

Figure 1:
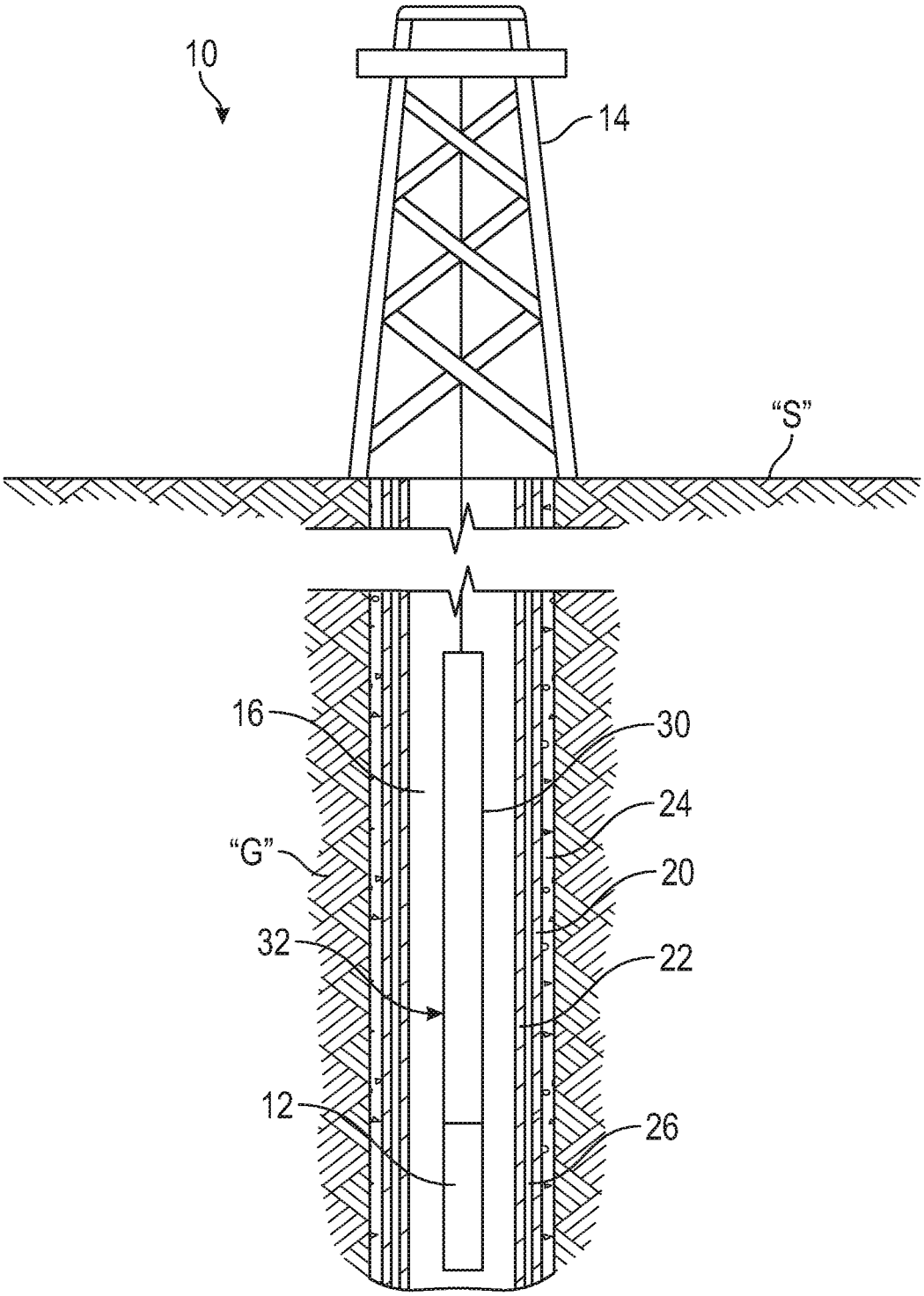
FIG. 1 is a partial cross-sectional side view of a wellbore system including a perorating tool according to the present disclosure.

FIG. 1 is a partial cross-sectional side view of a wellbore servicing system 10 that includes a perforating tool 12 in accordance with example embodiments of the present disclosure. The wellbore servicing system 10 includes a servicing rig 14 at a surface location "S." The servicing rig 14 extends over and around a wellbore 16 that penetrates a subterranean geologic formation "G." The wellbore 16 may be employed for the purpose of recovering hydrocarbons, storing hydrocarbons, disposing of carbon dioxide, or the like. The wellbore 16 may be drilled into the geologic formation "G" using any suitable drilling technique. While illustrated as extending vertically from the surface location "S" in FIG. 1, in other examples, the wellbore 16 may be deviated, horizontal, or curved over at least some portions of the wellbore 16. The wellbore 16 extends from a terrestrial surface location "S," and in other embodiments, a wellbore may extend from a subsea location in accordance with other aspects of the present disclosure.

The wellbore 16, as illustrated in FIG. 1, is cased with an outer casing 20 and an inner casing 22. The outer casing 20 is secured in place with cement 24, which fills the annular region between the outer casing and the geologic formation "G." The inner casing 22 extends within the outer casing 20 such that an annulus 26 is defined between the inner and outer casings 22, 20. In some example embodiments, the perforating tool 12 may be employed to access the target annulus 26 without penetrating the outer casing 20. In other embodiments, both casings 22, 20, cement 24 and the geologic formation "G" may be penetrated by the perforating tool 12. Also, a wellbore may alternately configured, e.g., the wellbore may be open hole, contain tubing, etc., and other regions in the wellbore may be targeted by the perforating tool 12.

The perforating tool 12 may be run-in, withdrawn, rotated and otherwise moved in wellbore 16 by a conveyance 30 extending to the surface location "S." The conveyance 30 may include a wireline, slickline, coiled tubing and/or a drill sting as recognized by those skilled in the art. The conveyance 30, perforating tool 12 and other devices may be coupled to one another to form a workstring 32.

Figure 2:
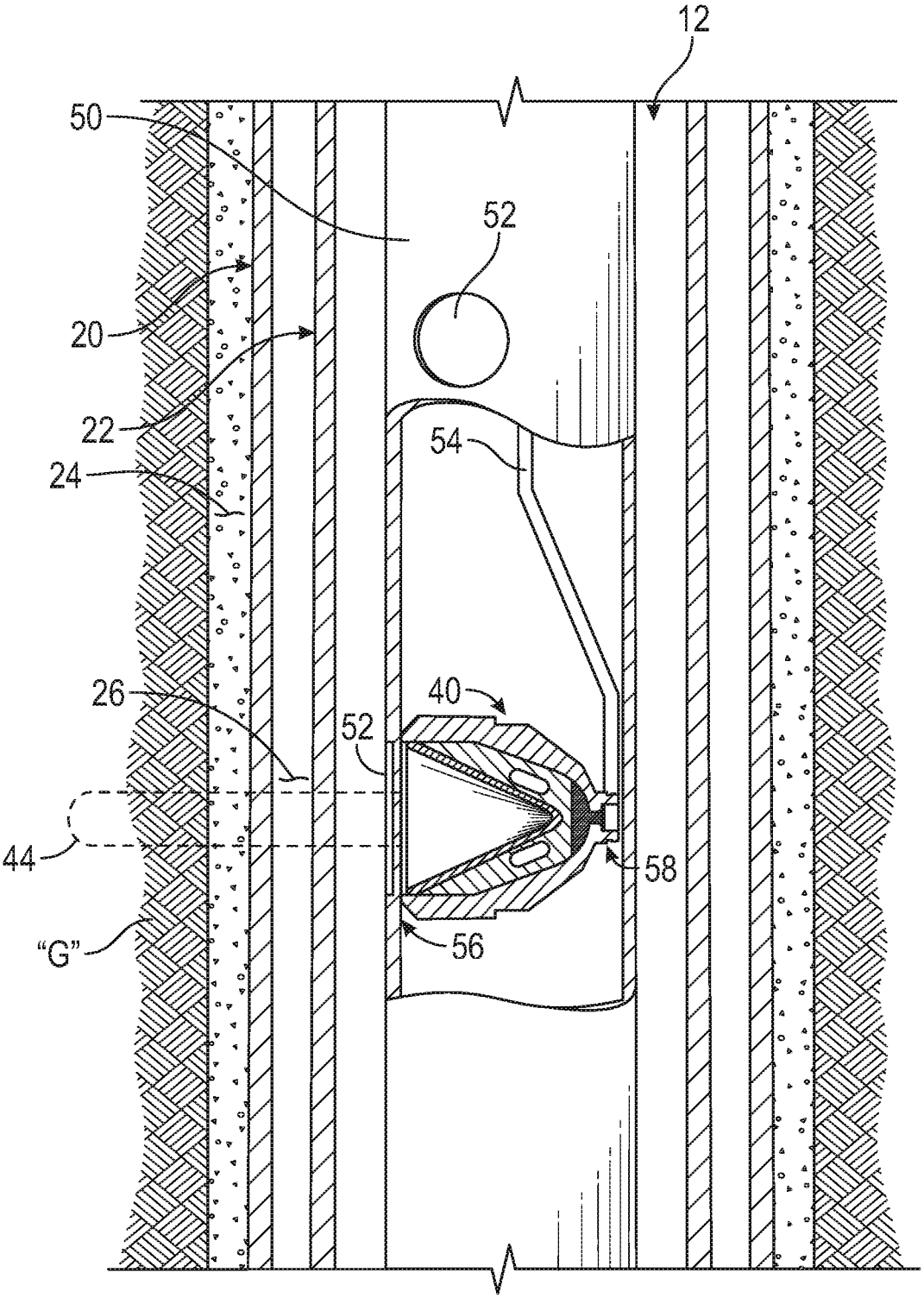
FIG. 2 is an enlarged, partial cross-sectional view of the perforating tool of FIG. 1 illustrating a shaped charge therein having an internal void formed in an explosive material by an additive manufacturing process.

FIG. 2 is an enlarged, partial cross-sectional view of the perforating tool 12 including a shaped charge 40 therein. Although the shaped charge 40 is illustrated as a deep penetrating charge, it should be appreciated that aspects of the present disclosure are transferrable to other types of shaped charges including big-hole or good-hole shaped charges. An explosion of the shaped charge 40 may result in a passageway 44 that extends through the inner casing 22, outer casing 20, and cement 24, and into the geologic formation "G." In other embodiments, a passageway could be formed that penetrates only to the annulus 26, for example.

The perforating tool 12 includes a carrier body 50 constructed of a cylindrical sleeve. In the embodiment illustrated, the carrier body 50 optionally includes a plurality of radially reduced areas depicted as scallops or recesses 52. Radially aligned with each of the recesses 52 is a respective one of a plurality of shaped charges 40, only one of which is illustrated in FIG. 2. A discharge end 56 of the shaped charge 40 is arranged adjacent the recess 52, and an initiation end. 58 end of the shaped charge 40 is arranged adjacent a detonator cord 54 extending through the perforating tool 12. The detonator cord 54 may be constructed of an explosive strand, such as a Primacord®, which may be detonated to thereby detonate each of the shaped charges 40 in the perforating tool 12. In some embodiments, the detonator cord 54, or portions thereof may be constructed by an additive manufacturing process. It will be appreciated that other components the explosive train in a perforating system, e.g., boosters, bidirectional boosters, detonators, etc. may also be constructed by an additive manufacturing process.

Each of the shaped charges 40 is longitudinally and radially aligned with one of the recesses 52 in carrier body 50 when perforating tool 12 is assembled. The shaped charges 40 may be arranged in a spiral pattern such that each of the shaped charges 40 is disposed on its own level or height and is to be individually detonated so that only one shaped charge 40 is fired at a time. It will be appreciated, however, that alternate arrangements of shaped charges 40 may be used, including cluster type designs wherein more than one shaped charge 40 is at the same level and is detonated at the same time, without departing from the principles of the present disclosure.

Figure 3:
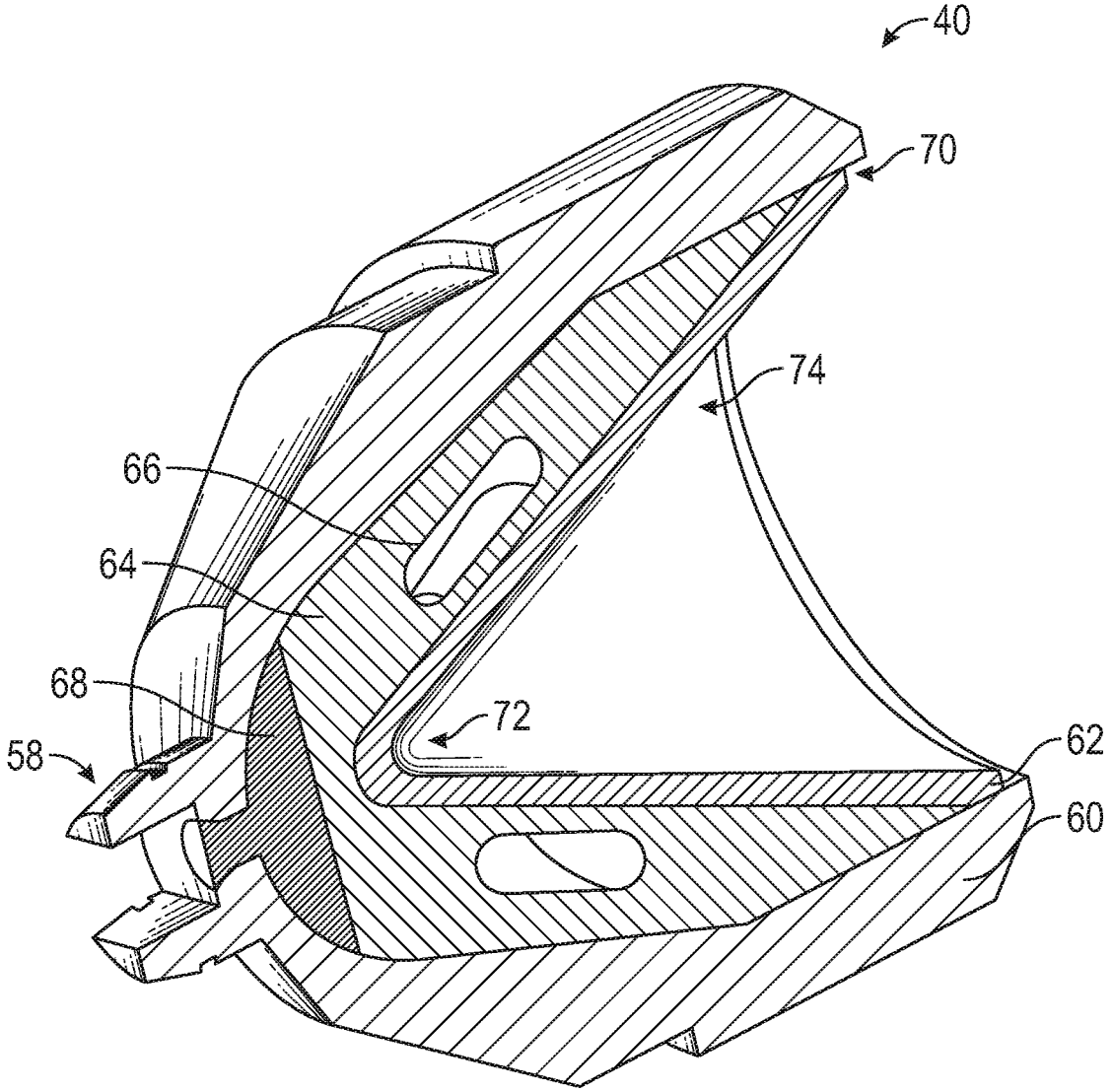
FIG. 3 is a cross-sectional perspective view of the shaped charge of FIG. 2 illustrating the explosive material enclosed within between a case and a liner.

Referring now to FIG. 3, the shaped charge 40 includes a case 60, a liner 62, and a main-load explosive material 64 disposed between the liner 62 and the case 60. A torpid-shaped void 66 having an oblong cross section is defined within the main-load explosive material 64, The void 66 may be readily formed as the main-load explosive material 64 is constructed by three-dimensional printing or other additive manufacturing processes. The void 66 is difficult to form by conventional processes wherein powdered explosive materials are pressed, cast, or extruded into various shapes. The void 66 is illustrated as empty or containing only atmospheric gasses. In other embodiments, the void 66 may be filled with non-explosive solid, an explosive having a different density or other characteristic, which might increase penetration of the passageway 44 into the geologic formation "G" (FIG. 2) and/or increase a hole size, e.g. a diameter of an opening formed through the inner casing 22, outer casing 20, cement 24 and into the geologic formation "G." In other embodiments, the penetration and/or hole size may be decreased by the void 66 or a material disposed within the void 66. In other embodiments, an increased or decreased hole size could be formed extending only to annulus 26, for example.

A booster explosive 68 may be disposed at the initiation end 58 of the shaped charge 40, and may operate to facilitate couple the main-load explosive material 64 to the detonation cord 54 (FIG. 2). The booster explosive 68 is illustrated without any voids defined therein. In other embodiments (see, e.g., FIG. 7), the booster explosive 68 is manufactured by three-dimensional manufacturing processes to include voids or other structures defined therein.

The case 60 operates to protect the inner explosive materials 64, 68 during handling and storage of the shaped charge 40, and provides a mass against which the explosion can react in operation. The case 60 may be constructed of steel, e.g., or another suitable material. The liner 62 can be attached to the case 60 by a glue bead or other mechanical mechanism defined between a liner skirt 70 and the case 60. The liner 62 may be constructed from any suitable material, including metallic materials, e.g., brass, copper, steel, aluminum, zinc, lead, tungsten and uranium (or combinations of these and other suitable materials). The liner 62 is generally parabolic or cone-shaped such that an apex 72 is defined at an innermost end of an external concavity 74 of the shaped charge 40. The shaped charge 40 may generally rely on a collapse of the liner 62 to develop a high speed jet for creating tunnels or passageways into the geologic formation "G" (FIG. 1) during a perforation event. Often shaped charges 40 are provided with at least a portion of the liner 62 constructed of a dense material that is present in this high speed jet. The energy that is thus transferred to the dense material may be more effectively concentrated to promote deeper tunnels.

Figure 4:
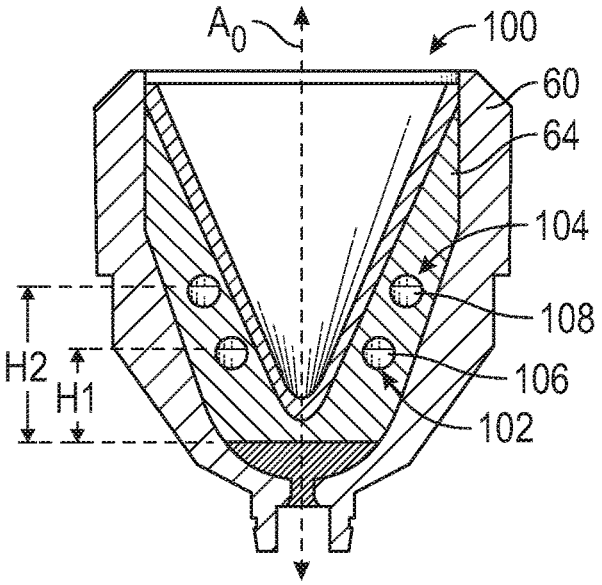
FIG. 4 is a cross sectional side view of an alternate embodiment of a shaped charge illustrating a pair of toroid-shaped voids having circular cross-sections formed in a main-load explosive material thereof.

FIG. 4 is a cross sectional side view of an alternate embodiment of a shaped charge 100 illustrating a pair of toroid-shaped voids 102, 104 having circular cross-sections formed in a main-load explosive material 64 thereof. The voids 102, 104 encircle an axis $A_0$ of the shaped charge 100, and are fully enclosed within the main-load explosive material 64. First and second fluid materials 106, 108 may be inserted into the voids during additive manufacturing process for forming the main-load explosive material 64. For instance, the main load explosive material may be deposited (into the case 60 or as a separate pellet) until the main load explosive material achieves a height "$H_1$" where a first void 102 is not yet closed, and the additive manufacturing process may be paused. The fluid 106 may be added, and thereafter, the additive manufacturing process may continue to enclose the fluid 106 within the void 102. Similarly, the manufacturing process may be paused at a second height $H_2$ to permit the fluid 108 to be added to the void 104. The fluids 106, 108 may be similar of distinct fluids to achieve various penetration effects. Although the voids 102, 104 are described as being filled with fluids 106, 108, the voids 102, 104 may be filled with any material distinct from the main load explosive material 64.

Figure 5:
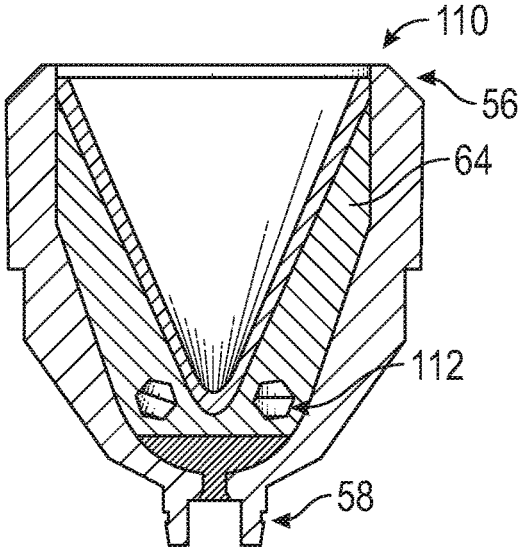
FIG. 5 is a cross sectional side view of an alternate embodiment of a shaped charge illustrating a toroid-shaped void having a hexagonal cross-section.

Referring now to FIG. 5, a cross sectional side view of an alternate embodiment of a shaped charge 110 having a toroid-shaped void 112 having a hexagonal cross-section is illustrated. Although a hexagonal cross section is illustrated, in other embodiments, other regular or irregular polygonal cross sections are contemplated. The void 112 exhibits flat sides meeting at sharp vertices. Such features may serve to direct the force of an explosion in a desired direction as the explosive material 64 is detonated form the ignition end 58 to the discharge end 56 of the shaped charge 110.

Figure 6:
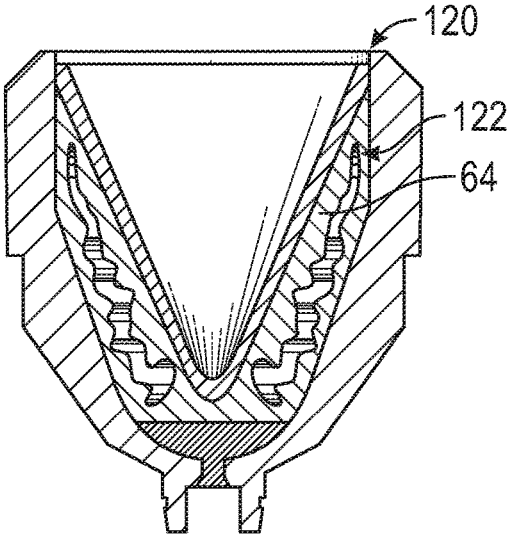
FIG. 6 is a cross sectional side view of an alternate embodiment of a shaped charge illustrating a toroid-shaped void having an irregular cross-section.

FIG. 6, is a cross sectional side view of an alternate embodiment of a shaped charge 120 illustrating a toroid-shaped void 122 having an irregular cross-section formed within the main load explosive material 64. The void 122 may be readily generated to have any symmetric or unsymmetrical shape by forming the main-load explosive 64 by additive manufacturing processes. In other embodiments, voids may be formed within a shaped charge, which are not necessarily torpid-shaped. Voids or pockets of diverse materials may be formed in the energetic materials or other components of a shaped charge that exhibit alternate geometries such as cubes, spheres, pyramids, etc.

Figure 7:
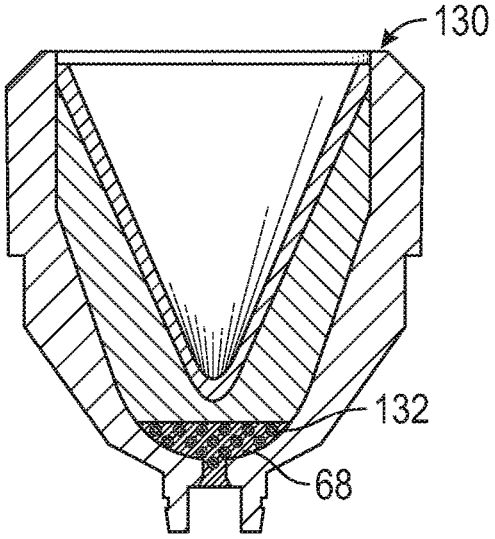
FIG. 7 is a cross sectional side view of an alternate embodiment of a shaped charge illustrating a plurality of voids formed in a booster explosive thereof.

Referring now to FIG. 7, a cross sectional side view of an alternate embodiment of a shaped charge 130 is illustrated including a plurality of voids 132 formed in the booster explosive 68. The voids 132 may extend through the booster explosive 68 and intersect an outer surface of the booster explosive 68 adjacent the case 60. In other embodiments, the voids 132 may be fully enclosed within the booster explosive 68.

The voids 66, 102, 104, 112, 122, 132 illustrated in FIGS. 3-7 represent a few, non-limiting examples of the shapes and configurations for voids that could be formed by producing an explosive 64, 68 for a shaped charge with an additive manufacturing process in accordance with principles of the present disclosure. The voids 66, 102, 104, 112, 122, 132 could be empty, and also represent areas where non explosive material could be added within the explosives 64, 68. Additionally, an explosive material having a different density or other characteristic could also be deposited into these voids 66, 102, 104, 112, 122, 132 without departing from the principles of the present disclosure.

Figure 8:
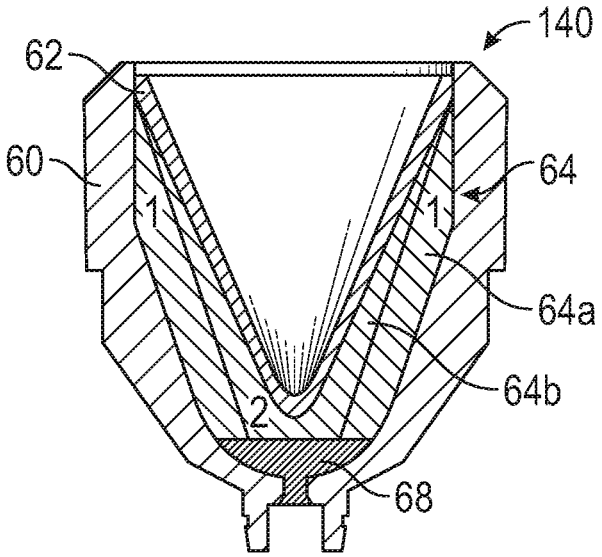
FIG. 8 is a cross sectional side view of an alternate embodiment of a shaped charge illustrating a plurality of distinct material layers formed in a main-load explosive thereof.

FIG. 8 is a cross sectional side view of an alternate embodiment of a shaped charge 140 illustrating a first and second distinct material layers 64*a*, 64*b* formed in a main-load explosive 64. The two distinct material layers 64*a*, 64*b* may have different or distinct densities or other characteristics that could produce a desired penetration effect. In some embodiments, the first material layer 64*a* and the booster explosive 68 may be deposited directly into the case 60 by an additive manufacturing process, and the second material layer may be deposited onto the liner 62. Then the liner 62 may be secured to the case 60 to complete the main load explosive 64. In other embodiments, both material layers 64*a*, 64*b* may be produced as a separate pellet, or together on one or the other of the liner 62 or the case 60.

Figure 9:
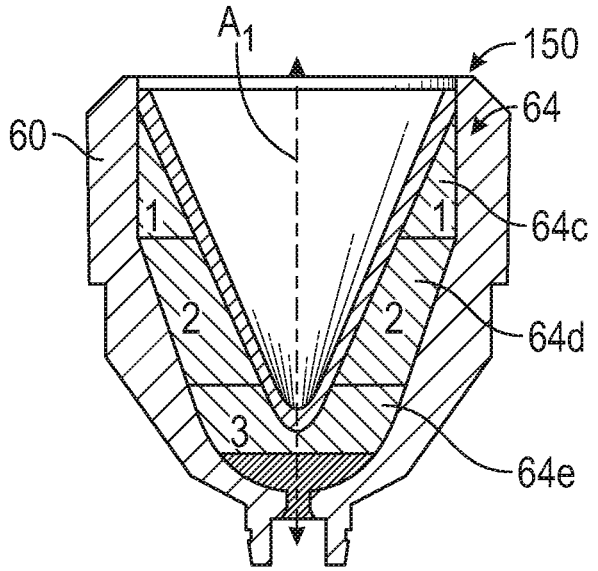
FIG. 9 is a cross sectional side view of an alternate embodiment of a shaped charge illustrating a plurality of distinct material layers formed in a main-load explosive thereof and arranged normal to an axis of the shaped charge.

Referring now to FIG. 9, a cross sectional side view of an alternate embodiment of a shaped charge 150 illustrating a plurality of distinct material layers 64*c*, 64*d* and 64*e* formed in a main-load explosive 64 is illustrated. The distinct material layers 64*c*, 64*d* and 64*e* are arranged normal to an axis $A_1$ of the shaped charge 150. In some embodiments, the booster explosive 68 may be 3-D printed into the case 60, and then the distinct material layers, 64*c*, 64*d*, and 64*e* may be 3-D printed onto the booster material.

Figure 10:
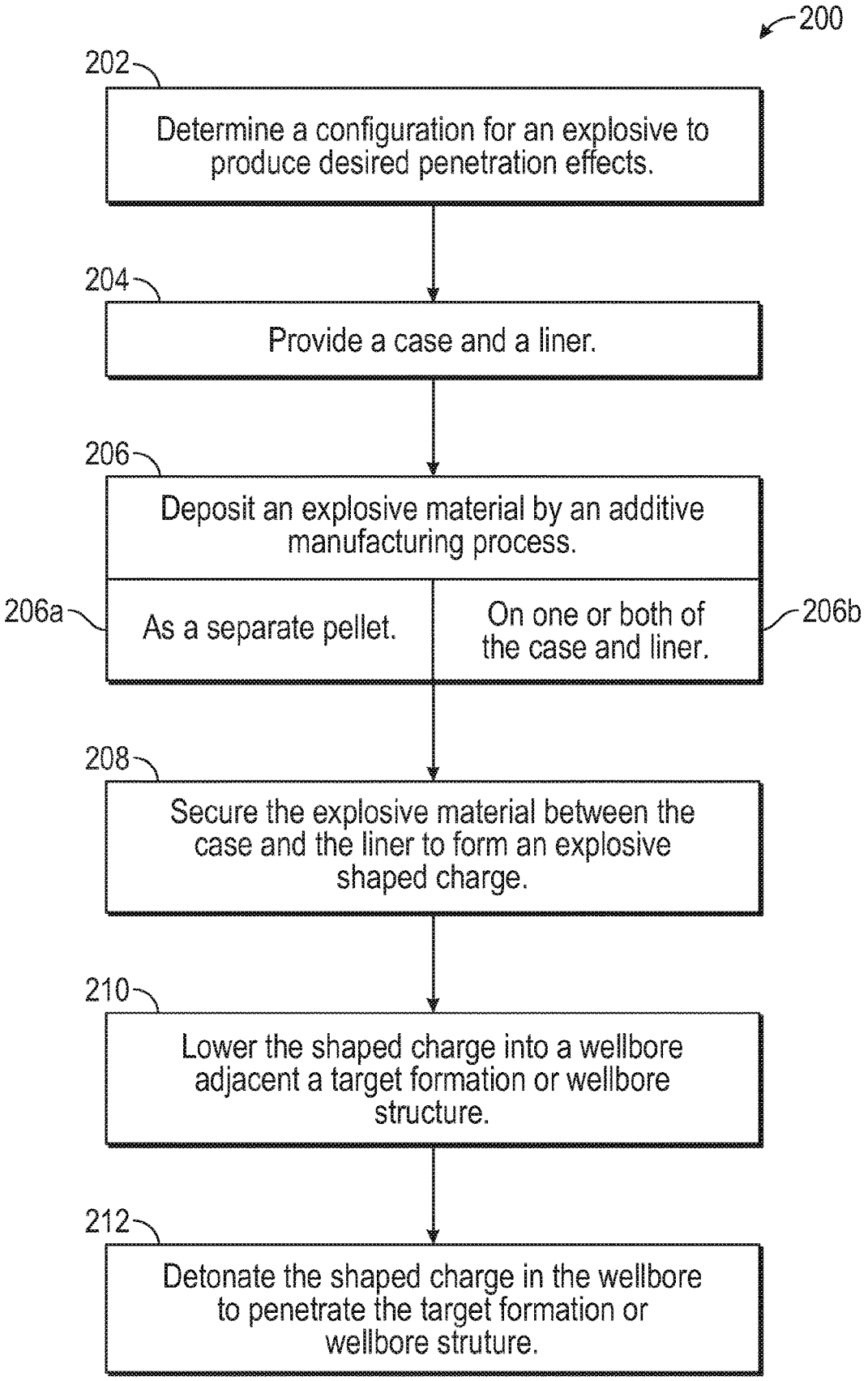
FIG. 10 is a diagrammatic view of a procedure for planning, constructing and discharging a shaped charge according to example embodiments of the present disclosure.

FIG. 10 is a diagrammatic view of a procedure 200 for planning, constructing and discharging a shaped charge 40 according to example embodiments of the present disclosure, Initially at step 202, the procedure 200 begins by determining an explosive configuration that will produce a desired penetration effect. The explosive configuration may include a shape of main-load explosive 64 and/or booster explosive 68 including any voids and/or density gradients in the explosives 64, 68 to produce the desired penetration effect in a wellbore 16. The explosive configuration may be determined empirically, e.g., by testing actual sample explosive configurations, and/or by simulating a perforation event in computer model environment using CAD data. Intermediate values may be interpolated and/or estimated based on the empirical or simulated testing.

Next, at step 204, a case 60 and a liner 62 may be provided to support the explosive configuration determined to produce the desired penetration effect or hole size. The case 60 and liner 62 may be conventional or commercially available components in some embodiments, and in other embodiments, the case 60 or liner 62 may be produced using additive manufacturing processes, e.g., to include voids or density gradients therein.

At step 206, the explosive materials 64, 68 are deposited by an additive manufacturing process such as three-dimensional printing using 3-D printing machines processes and methods. Various techniques have been developed to use 3-D printers to create prototypes and manufacture products using 3-D design data. See, for example, information available at the Web sites of Z Corporation (www.zcorp.com); Pro Metal, a division of the XI Company (www.prometal-.com); EQS GmbH (www.eos.info); 3-D Systems, Inc. (www.3-Dsystems.com); and Stratasys, Inc., (www.stratasys.com and www.dimensionprint.ing.com).

The three-dimensional components that make up the shaped charges 40, 100, 110, 120, 130, 140, 150, other energetic materials and other components disclosed herein may be fabricated directly using a 3-D printer in combination with 3-D design data. 3-D printing is generally a process of making a three-dimensional object from digital design data. 3-D printing is distinct from traditional machining, and is also distinct from traditional methods of fabricating composite components. One method of 3-D printing comprises fabricating three-dimensional objects from computer design models using a material deposition process for example extrusion based layering. Extrusion based layered deposition systems (referred to alternatively as fused deposition modeling systems (FDM systems) may be used to build 3-D objects from CAD or other computer design models in a layer-by-layer fashion by extruding flowable materials such as a thermoplastic material mixed with explosive powders. Information regarding such 3-D fabricating processes may be located at the Stratasys Web site.

The explosive materials 64, 68 may be deposited as a separate pellet independent of the case 60 and liner 62 (step 206*a*), deposited directly onto one or both of the case 60 and liner 62 (step 206*b*), or combinations of both. The voids 66, 102, 104, 112, 122, 132 may be formed from interruptions in appropriate layers, and the additive manufacturing process may be paused to permit the addition of fluids, e.g., fluids 106, 108 (FIG. 4), non-explosive materials or other components as necessary to produce the explosive configuration determined in step 202.

Next at step 208, the explosive materials 64, 68 are secured between the case and the liner to form the explosive charges 40, 100, 110, 120, 130, 140, 150. For example, the liner 62 can be attached to the case 60 by a glue bead or other mechanical mechanism. The resulting shaped charges 40, 100, 110, 120, 130, 140, 150 may then be lowered into a wellbore 16 to a downhole location adjacent a target annulus or geologic formation "G" (step 210). The shaped charges 40, 100, 110, 120, 130, 140, 150 may then be detonated in the wellbore 16 to penetrate any target annulus 26 and/or geologic formation "G."

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter. In one aspect, the disclosure is directed to a shaped charge operable for forming a perforation in a wellbore. The shaped charge includes a case, at least one explosive disposed within the case and a liner coupled to the case and substantially enclosing the explosive within the case. The at least one explosive is formed by an additive manufacturing process.

In some embodiments, the at least one explosive includes an interior void defined therein. The interior void may include at least one of the group consisting of a toroid-shape, an oblong cross section, a polygonal cross section and an irregular cross section. In some embodiments, the interior void includes at least one of the group consisting of atmospheric gasses, liquids, and non-explosive materials disposed therein. In some embodiments, the interior void is defined in a booster explosive formed at an ignition end of the shaped charge.

In one or more example embodiments, the at least one explosive comprises a plurality of distinct material layers defining a density gradient within the case of the shaped charge. The plurality of distinct material layers may be disposed adjacent the liner and a second of the plurality of distinct material layers is disposed adjacent the case.

According to another aspect, the disclosure is directed to a method of fabricating a shaped charge. The method includes (a) providing a case and a liner, (b) depositing at least one explosive material by an additive manufacturing process, and (c) coupling the liner coupled to the case to substantially enclose the at least one explosive within the case.

In one or more example embodiments, the at least one explosive material is deposited directly onto at least one of the liner and the case in the additive manufacturing process. Alternatively, the at least one explosive material may be deposited as a pellet separate from the liner and the case in the additive manufacturing process.

In some embodiments, the method further includes forming at least one void in the at least one explosive material in the additive manufacturing process. The method may further include pausing the additive manufacturing process when the at least one void is open, filling the at least one void with a material distinct from the at least one explosive material, and resuming the additive manufacturing process to enclose the material distinct from the at last one explosive material within the at least one void.

In some example embodiments, the method further includes forming a density gradient in the at least one explosive material by the additive manufacturing process. The method may further include forming distinct material layers in the at least one explosive to define the density gradient. In some embodiments, the method may further include forming the distinct material layers normal to an axis of the shaped charge. In some embodiments, the method further includes depositing a first one of the distinct material layers onto the liner and a second one of the distinct material layers onto the case by the additive manufacturing process. In some embodiments, the additive manufacturing process is a three-dimensional punting process.

According to another aspect, the disclosure is directed to a perforating tool system for forming a perforation in a wellbore. The perforating tool incudes a carrier body constructed of a cylindrical sleeve, and a plurality of shaped charges disposed within the carrier body. Each of the shaped charges has a case, a liner and at least one explosive formed by an additive manufacturing process and substantially enclosed by the case and the liner.

In one or more example embodiments, the perforating tool system further includes a detonator cord extending through the carrier body and coupled to each of the shaped charges. At least a portion of the detonator cord may be constructed by an additive manufacturing process. In some embodiments, the perforating tool system further includes a conveyance coupled to the carrier body, the conveyance operable to lower the carrier body into a wellbore.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of fabricating a shaped charge to produce perforation in a wellbore, the method comprising:

providing a charge and a liner;

depositing at least one explosive material by an additive manufacturing process forming at least one void in the at least one explosive material in the additive manufacturing process;

pausing the additive manufacturing process when the at least one void is open, filling the at least one void with a material distinct from the at least one explosive material, and resuming the additive manufacturing process to enclose the material distinct from the at least one explosive material within the at least one void; and coupling the liner to the case to substantially enclose the at least one explosive within the case.

2. A shaped charge fabricated by the method of claim 1, the shaped charge operable for forming a perforation in a wellbore, the shaped charge comprising:

the case;

the at least one explosive disposed within the case, wherein the at least one explosive is formed by the additive manufacturing process; and the material distinct from the at least one explosive material filled into the void as a fluid.

3. The shaped charge according to claim 2, wherein the interior void comprises at least one of the group consisting of a toroid-shape, an oblong cross section, a polygonal cross section and an irregular cross section.

4. The shaped charge according to claim 3, wherein the interior void is filled with at least one of the group consisting of atmospheric gasses, liquids, and non-explosive materials disposed therein.

5. The shaped charge according to claim 4, wherein the interior void is filled with a liquid to a predetermined height.

6. The shaped charge according to claim 2, wherein the interior void is defined in a booster explosive formed at an ignition end of the shaped charge.

7. The shaped charge according to claim 2, wherein the at least one explosive comprises a plurality of distinct material layers defining a density gradient within the case of the shaped charge.

8. The shaped charge according to claim 7, wherein a first of the plurality of distinct material layers is disposed adjacent the liner and a second of the plurality of distinct material layers is disposed adjacent the case.

9. A perforating tool system for forming a perforation in a wellbore, the perforating tool comprising:

a carrier body constructed of a cylindrical sleeve;

a plurality of shaped charges according to claim 2 disposed within the carrier body.

10. The perforating tool system according to claim 9, further comprising a detonator cord extending through the carrier body and coupled to each of the shaped charges, wherein at least a portion of the detonator cord is constructed by an additive manufacturing process.

11. The perforating tool system according to claim 9, further comprising a conveyance coupled to the carrier body, the conveyance operable to lower the carrier body into a wellbore.

12. The method according to claim 1, wherein the at least one explosive material is deposited directly onto at least one of the liner and the case in the additive manufacturing process.

13. The method according to claim 1, wherein the at least one explosive material is deposited as a pellet separate from the liner and the case in the additive manufacturing process.

14. The method according to claim 1, further comprising forming a density gradient in the at least one explosive material by the additive manufacturing process.

15. The method according to claim 14, further comprising forming distinct material layers in the at least one explosive to define the density gradient.

16. The method according to claim 15, further comprising forming the distinct material layers normal to an axis of the shaped charge.

17. The method according to claim 1, wherein the additive manufacturing process is a three-dimensional printing process.

18. A method of fabricating a shaped charge to produce perforation in a wellbore, the method comprising:

providing a charge and a liner;

depositing at least one explosive material by an additive manufacturing process;

forming distinct material layers in the at least one explosive to define a density gradient in the at least one explosive material by the additive manufacturing process;

depositing a first one of the distinct material layers onto the liner and a second one of the distinct material layers onto the case by the additive manufacturing process;

coupling the liner to a case to substantially enclose the at least one explosive within the case.

19. The method according to claim 18, further comprising forming at least one void in the at least one explosive material in the additive manufacturing process.

20. The method according to claim 19, further comprising pausing the additive manufacturing process when the at least one void is open, filling the at least one void with a material distinct from the at least one explosive material, and resuming the additive manufacturing process to enclose the material distinct from the at least one explosive material within the at least one void.

* * * * *